US008957818B2

(12) United States Patent
Chen

(10) Patent No.: US 8,957,818 B2
(45) Date of Patent: Feb. 17, 2015

(54) CIRCULARLY POLARIZED WAVEGUIDE SLOT ARRAY

(75) Inventor: Ming H. Chen, Rancho Palos Verdes, CA (US)

(73) Assignee: Victory Microwave Corporation, New Taipei (TW)

( * ) Notice: Subject to any disclaimer, the term of this patent is extended or adjusted under 35 U.S.C. 154(b) by 236 days.

(21) Appl. No.: 13/487,254

(22) Filed: Jun. 4, 2012

(65) Prior Publication Data

US 2013/0050039 A1 Feb. 28, 2013

Related U.S. Application Data

(60) Provisional application No. 61/525,870, filed on Aug. 22, 2011.

(51) Int. Cl.

| | |
|---|---|
| ***H01Q 13/00*** | (2006.01) |
| ***H01Q 13/10*** | (2006.01) |
| ***H01Q 13/22*** | (2006.01) |
| ***H01Q 21/06*** | (2006.01) |
| ***H01Q 21/24*** | (2006.01) |

(52) U.S. Cl.

CPC ..... *H01Q 13/22* (2013.01); *H01Q 21/068* (2013.01); *H01Q 21/24* (2013.01)

USPC ..... 343/772; 343/768; 343/770

(58) Field of Classification Search

CPC ..... H01Q 21/005; H01Q 21/24; H01Q 13/22; H01Q 21/068

USPC ..... 343/768

See application file for complete search history.

(56) References Cited

U.S. PATENT DOCUMENTS

| | | | | |
|---|---|---|---|---|
| 3,328,800 | A | 6/1967 | Algeo | |
| 3,503,073 | A | 3/1970 | Ajoika | |
| 4,266,228 | A * | 5/1981 | Perrotti | 343/771 |
| 5,638,079 | A | 6/1997 | Kastner | |
| 2004/0145526 | A1 * | 7/2004 | Puente Baliarda et al. MS | 343/700 |
| 2006/0132374 | A1 | 6/2006 | Wang | |

* cited by examiner

*Primary Examiner* — Dameon E Levi
*Assistant Examiner* — Ricardo Magallanes
(74) *Attorney, Agent, or Firm* — Clifford Perry

(57) ABSTRACT

A circularly polarized waveguide slot array includes first and second waveguide sections, the first waveguide section extending along a longitudinal axis, and including an antenna element for transmitting or receiving a circularly polarized signal. The second waveguide slot section is coupled side-to-side with the first waveguide slot section and extends along the longitudinal axis, the second waveguide slot section including an antenna element for transmitting or receiving the circularly polarized signal at a phase which is substantially complementary to the circularly polarized signal transmitted by or received by the first waveguide slot section. Further exemplary, the antenna element disposed on the first waveguide slot section is offset from said antenna element disposed on the second waveguide slot section substantially one half of a predefined guide wavelength $\lambda_g$ along said longitudinal axis.

12 Claims, 11 Drawing Sheets

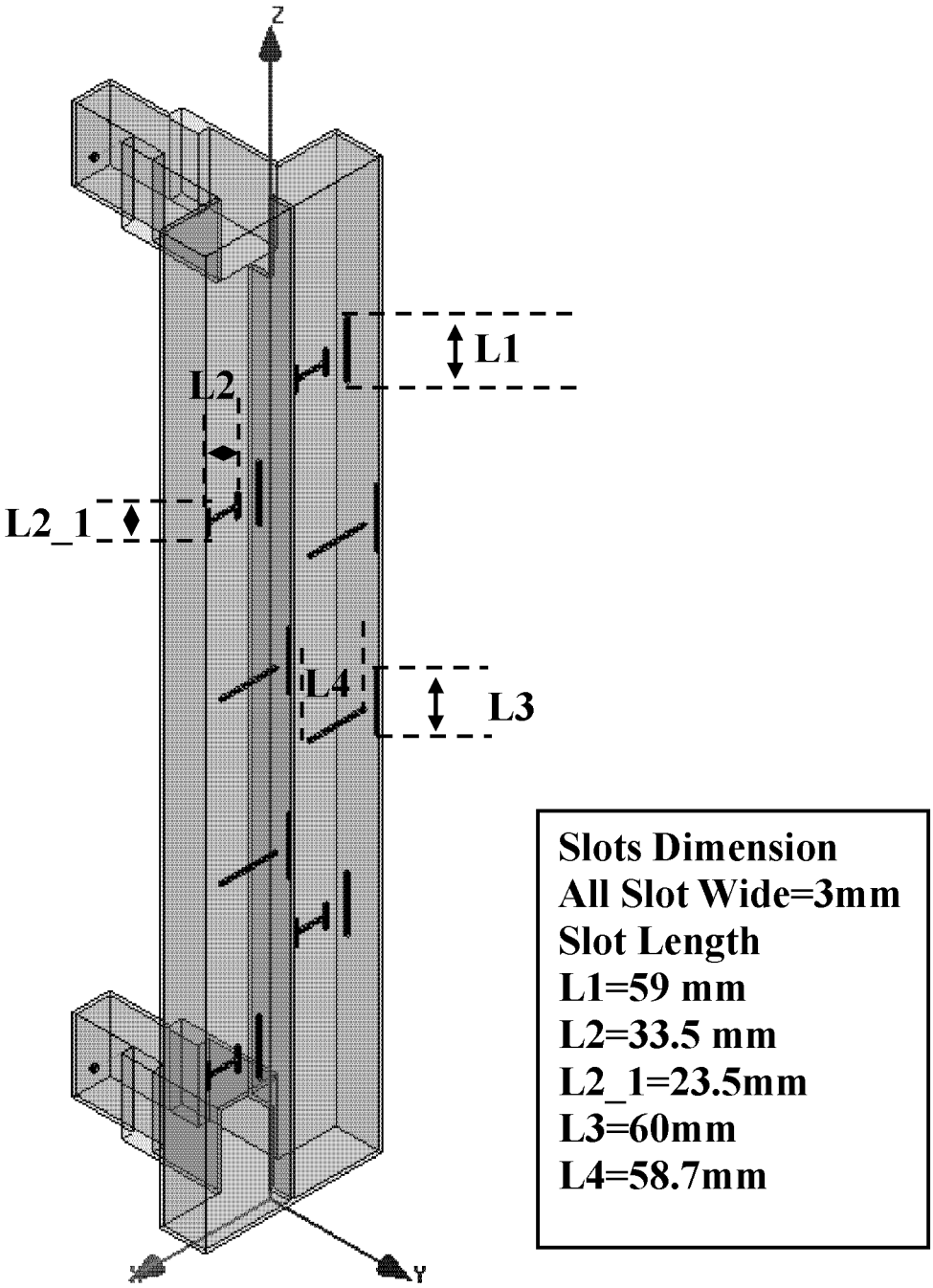
Fig.4 2.4-2.5 GHz Slot Array

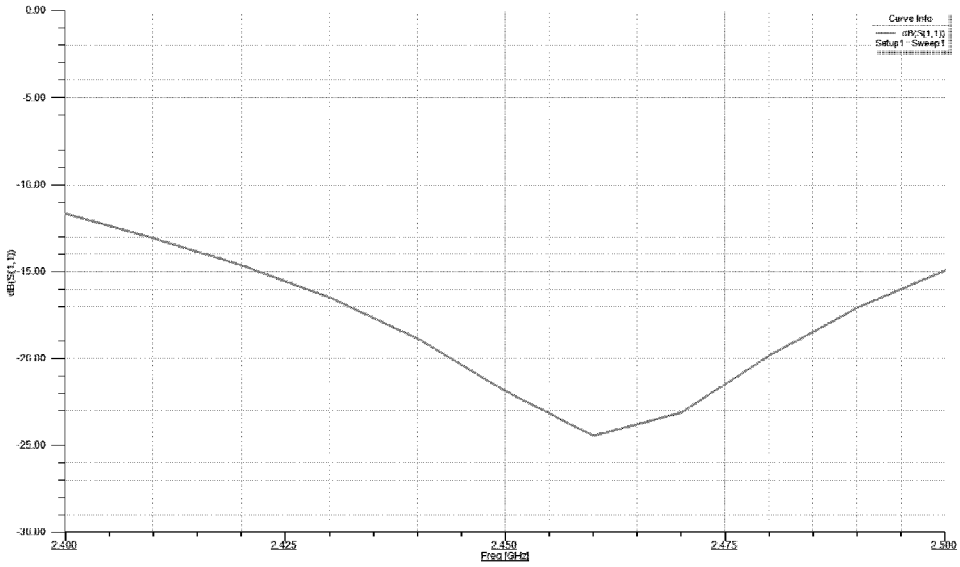
Fig.5 Calculated Return Loss for Slot Array of Fig.3
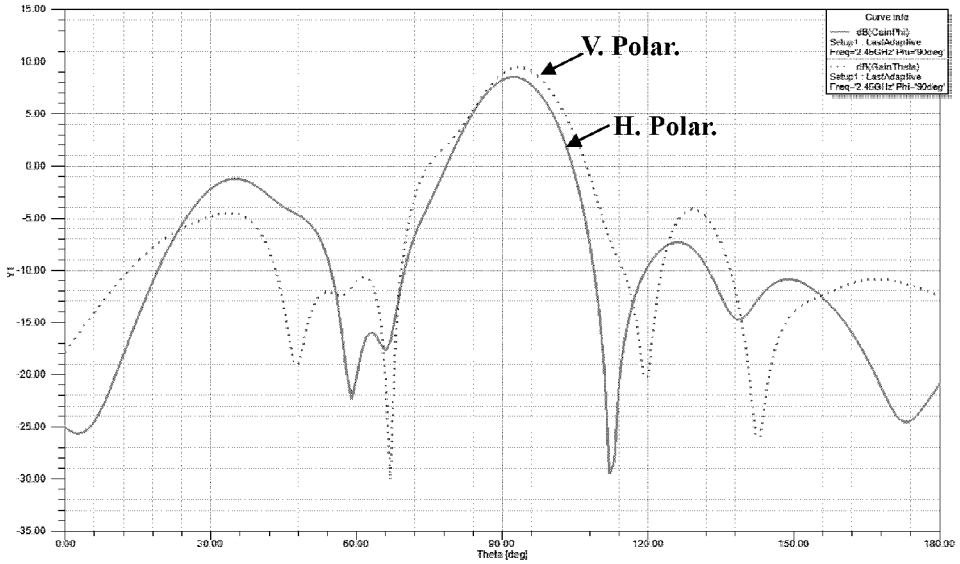
Fig.6(a) Calculated Elevation Pattern for Slot Array of Fig.3

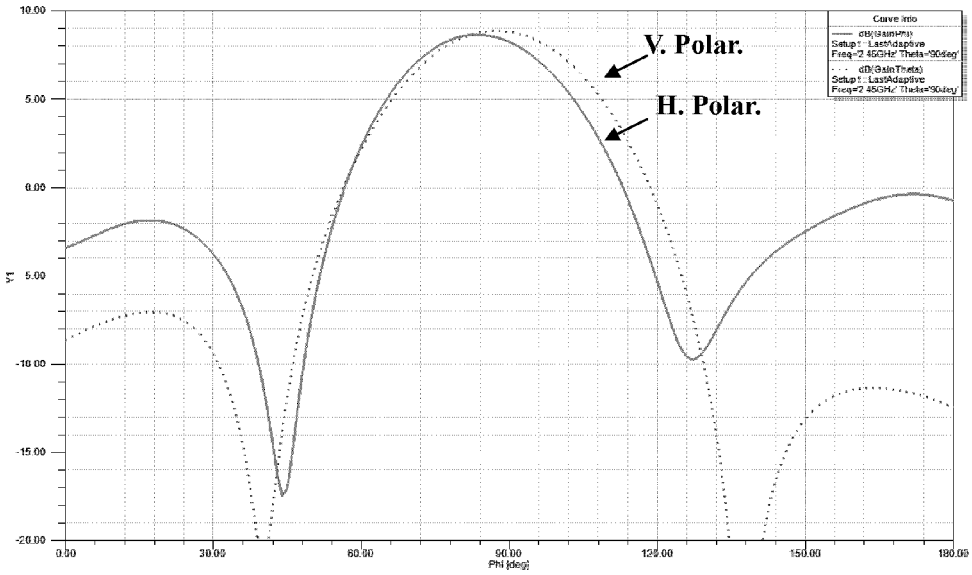
Fig.6(b) Calculated Azimuth Pattern for Slot Array of Fig.3

CIRCULARLY POLARIZED WAVEGUIDE SLOT ARRAY

CROSS REFERENCE TO RELATED APPLICATIONS

This application claims the benefit of priority from U.S. provisional patent application 61/525,870 filed Aug. 22, 2011, the contents of which are herein incorporated by reference for all purposes.

BACKGROUND

The present invention relates to waveguide antennae, and more particularly to circularly polarized waveguide antennae.

FIG. 9 illustrates a first conventionally known circularly polarized antenna array 900. In this configuration, the circularly polarized antenna array employs two linearly-polarized antenna elements 912 and 914 with 90 degree phase difference, the 90 degree phase difference usually provided by a hybrid coupler 920. Multiple instances of the antenna waveguide elements 912/914 and accompanying hybrid coupler 920 are implemented to complete construction of the array, and a power divider 930 is used to supply each of the hybrid couplers 920 forming the array 900.

FIG. 10 illustrates a second conventionally known circularly polarized waveguide slot array 1000. Each array element 1010 consists of a circularly polarized waveguide antenna and septum polarizer, an example of which is disclosed in the commonly-owned U.S. Pat. No. 6,118,412. A power divider 1020 is used to feed each of the array elements 1010.

In each of the conventional implementations of FIGS. 9 and 10, the spacing between the array elements (e.g., between a first instance of elements 912/914 and a second instance of elements 912/914 in FIG. 9) must not be excessively large, otherwise grating lobes will appear. For example, if the spacing between neighboring array elements is greater than $\lambda g/2$, grating lobes will appear ($\lambda g$ represents the guide wavelength of a signal intended to propagate within the waveguide). However at the expected frequency of operation, the separation $\lambda g/2$ is quite small, and keeping the spacing of contiguous array elements within this distance is difficult to realize.

What is needed is a new design for a circularly polarized waveguide slot array which will overcome the aforementioned difficulties.

SUMMARY

A circularly polarized waveguide slot array is now presented which addresses one or more of the aforementioned disadvantages in the art. One embodiment of the array includes first and second waveguide sections, the first waveguide section extending along a longitudinal axis, and including an antenna element for transmitting or receiving a circularly polarized signal. The second waveguide slot section is coupled side-to-side with the first waveguide slot section and extends along the longitudinal axis, the second waveguide slot section including an antenna element for transmitting or receiving the circularly polarized signal at a phase which is substantially complementary to the circularly polarized signal transmitted by or received by the first waveguide slot section. Further exemplary, the antenna element disposed on the first waveguide slot section is offset from said antenna element disposed on the second waveguide slot section substantially one half of a predefined guide wavelength $\lambda_g$ along said longitudinal axis.

In another embodiment, the circularly polarized waveguide includes a plurality of waveguide slot sections extending along a longitudinal axis and coupled side-to-side, and each waveguide section including a plurality of antenna elements operable for transmitting or receiving a circularly polarized signal. One of the plurality of antenna elements disposed on a first waveguide section is offset along the longitudinal axis relative to one of the plurality of antenna elements disposed on a second waveguide section. Further particularly, each of the plurality of antenna elements comprises a longitudinal slot extending along said longitudinal axis and a traverse slot extending substantially orthogonal to the longitudinal slot.

Further aspects of the invention will be better understood in view of the following drawings and detailed description of exemplary embodiment.

BRIEF DESCRIPTION OF THE DRAWINGS

FIG. 4 illustrates waveguide and slot dimensions for an exemplary circularly polarized waveguide antenna array in accordance with the present invention;

FIGS. 5, 6A and 6B illustrate exemplary return loss and elevation and azimuth radiation patterns, respectively, for an exemplary circularly-polarized waveguide slot array in accordance with the present invention;

For clarity, reference numbers used in previous drawings are retained in subsequent drawings.

DETAILED DESCRIPTION OF EXEMPLARY EMBODIMENTS

Figure 1:
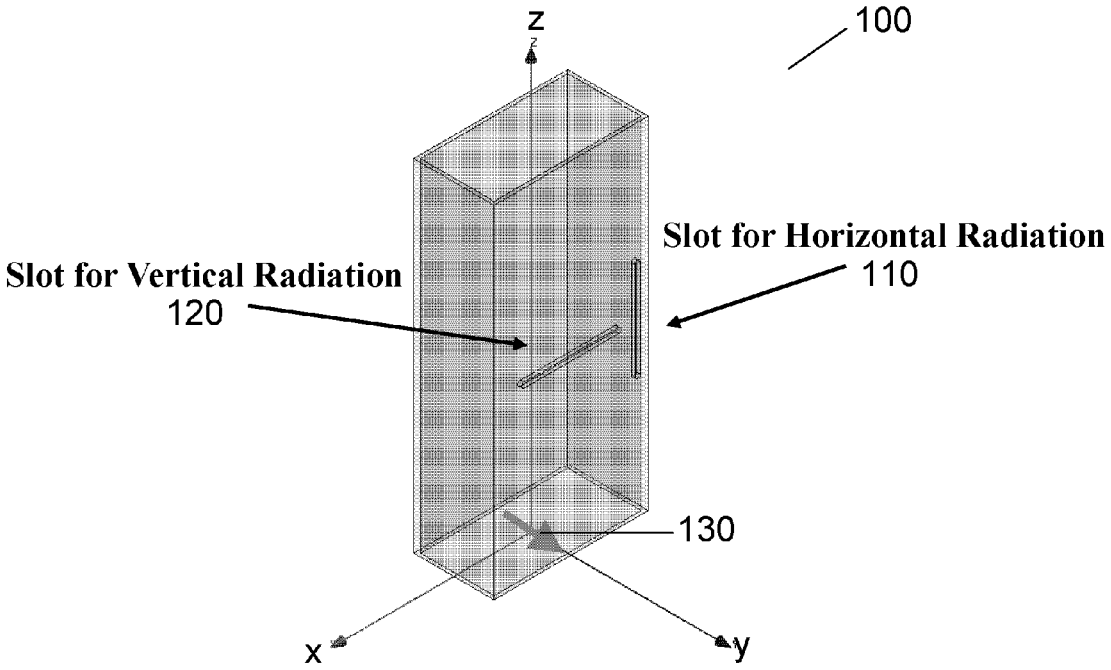
FIG. 1 illustrates a waveguide slot antenna operable to produce circular polarized radiation in accordance with the present invention.

FIG. 1 illustrates a waveguide slot antenna 100 operable to produce circular polarized radiation in accordance with the present invention. A slot cut on the waveguide wall will be excited by the electromagnetic field inside the waveguide and produce radiation. Signal 130 is applied to the waveguide slot antenna 100, and the narrow and long slots are excited by the magnetic field inside the waveguide slot antenna 100. A longitudinal slot 110 extending along the longitudinal direction is excited by the longitudinal magnetic field, Hz, of the applied signal 130. This slot will radiate Ex field outside the waveguide slot antenna 100. A traverse slot 120 extending along the transverse direction is excited by transverse magnetic field, Hx, of the applied signal 130. This slot will radiate Ez field outside the waveguide slot antenna 100. The magnetic fields Hz and Hx inside the waveguide are phase offset by 90 degree, and thus the radiating fields Ex and Ez will also exhibit this 90 degree phase difference, resulting in a circular polarized wave radiation pattern for the waveguide slot antenna 100.

Together, slots 110 and 120 (referred herein to as a "slot pair" herein) form an antenna element for the slot antenna 100. Spacing each slot pair one wavelength apart along the waveguide slot antenna 100 will produce in-phase excitation and a broadside radiation pattern for a circular polarized signal. Unfortunately, spacing the slot pairs more than one half wavelength apart will produce undesired grating lobes.

Figure 2A:
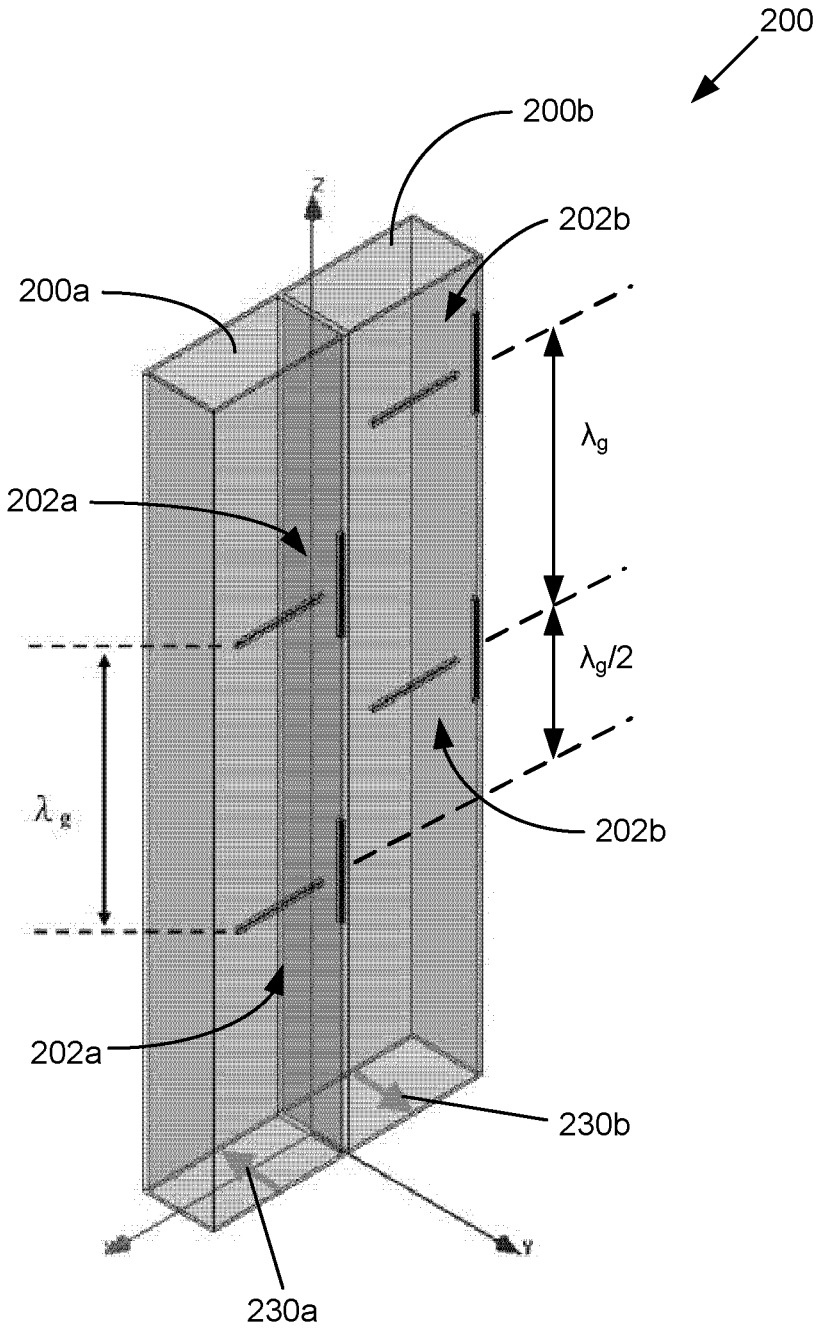
FIG. 2A illustrates a first embodiment of a circularly-polarized waveguide slot array in accordance with the present invention.

To overcome this deficiency, two waveguide slot antennae 200*a* and 200*b* (also referred to herein as "waveguide sections" of a collective waveguide slot array) are positioned side-by-side along a common longitudinal axis (shown as the z-axis), forming a waveguide slot array 200 shown in FIG. 2A. In this configuration, the slot pairs 202*a* and 202*b* on respective different waveguide sections 200*a* and 200*b* are positioned such that they are offset by substantially one half guide wavelength ($\lambda_g/2$) relative to each other, and each slot pair is repeated substantially one guide wavelength $\lambda_g$ along the same waveguide antenna. The one half guide wavelength ($\lambda_g/2$) separation between slot pairs 202*a* and 202*b* produces substantially complementary-phased grating lobe patterns which combine to reduce/eliminate the collective grating lobe for the circularly-polarized waveguide slot array 200.

Further in accordance with the invention, the first and second waveguide antennae 200*a* and 200*b* are operable to transmit/receive substantially equal amplitude and complementary-phased signals 230*a* and 230*b*. In such an arrangement, the complementary phasing of the transmitted/received signals 230*a* and 230*b* and the complimentary phasing of the slot pairs 202*a* and 202*b* collectively operate to produce an in-phase broadside radiation pattern for a circularly polarized signal, similar to that of the single waveguide 100 shown in FIG. 1, but with much smaller (if any) grating lobes.

Figure 2B:
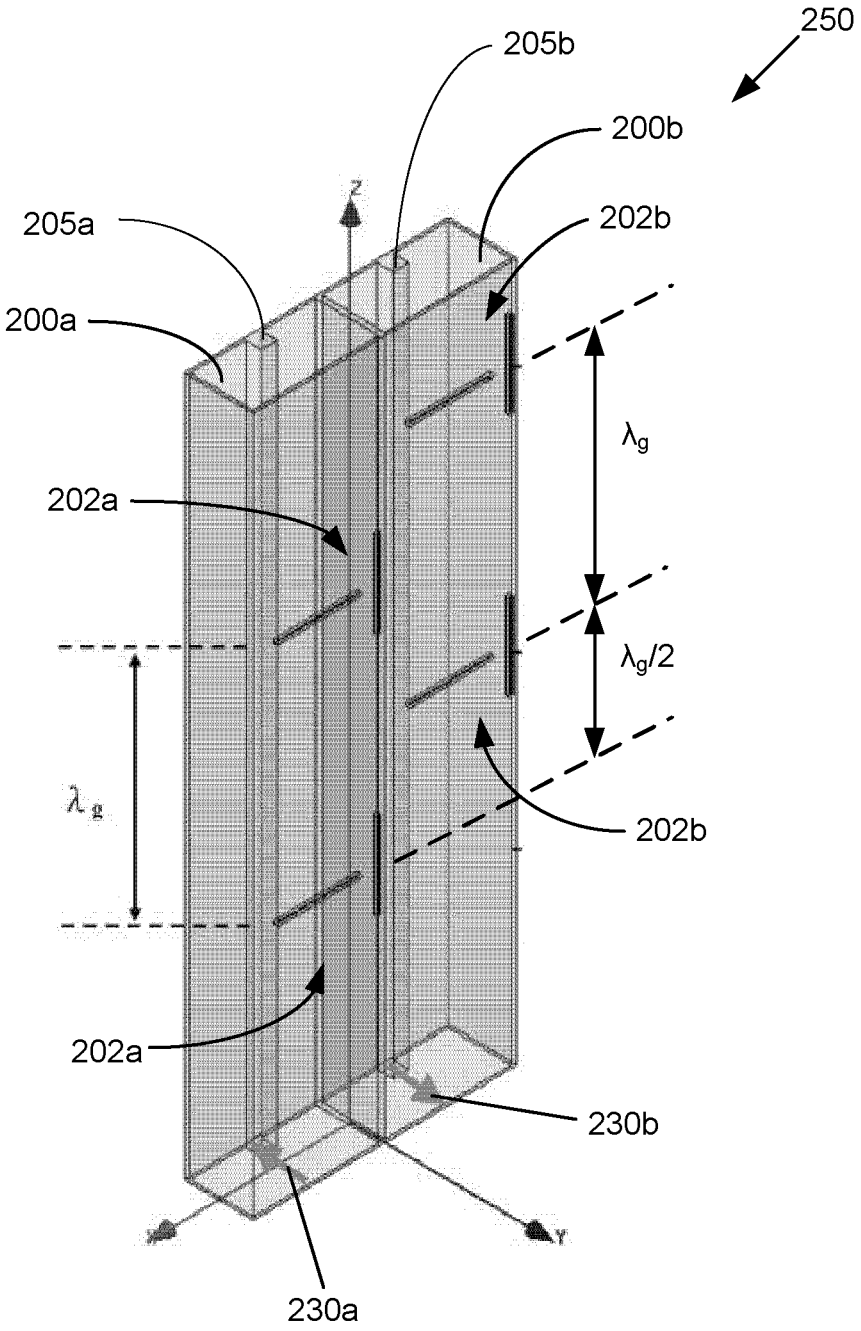
FIG. 2B illustrates a second embodiment of a circularly-polarized waveguide slot array in accordance with the present invention.

FIG. 2B illustrates a second embodiment of a circularly-polarized waveguide slot array 250 in accordance with the present invention, with previously-described features retaining their reference indices. The first and second waveguide sections 200*a* and 200*b* further include ridges 205*a* and 205*b*, respectively. Each ridge is disposed on the bottom plane (background of the drawing) of the waveguide section, and the opposing top plane of the waveguide (foreground of the drawing) includes the slot pairs. By using the ridge waveguide structure, the width dimension of the waveguide sections 200*a* and 200*b* can be made smaller at the frequency of operation, and thus the separation between a first slot pair on the first waveguide section 200*a* and a second slot pair on the second waveguide section 200*b* is reduced. This reduction in separation between slot pairs disposed on adjacent waveguide sections improves the radiation pattern on the azimuth plane. The spacing between the slot pairs disposed on the same waveguide section will also be reduced, which provides more flexibility in design.

While the slot pairs on the adjacent waveguide sections are spaced apart λg/2 in the exemplary embodiments of FIGS. 2A and 2B, the skilled person will appreciate that this slot pair spacing may be any distance less than or equal to λg/2 to avoid the formation of grating patterns as discussed above. In particular, slot pairs on neighboring waveguide sections may be spaced apart a distance of λg/16, λg/8, λg/4 or λg/2. More generally, the slot pair spacing may be any dimension λg/N, where λg is as defined above, and N is an even number of waveguide sections implemented in the waveguide slot array per λg, i.e., the even number of slot pair spacings that will add up to one complete guide wavelength $\lambda_g$. In the illustrated embodiments of FIGS. 2A and 2B, two waveguide sections of 200*a* and 200*b* are implemented for the slot pair spacing of λg/2. It is to be understood that the array 200 may implement multiple instances of waveguide sections 200*a* and 200*b* in order to obtain greater uniformity in the antenna pattern for the array, as known in the art.

Figure 3:
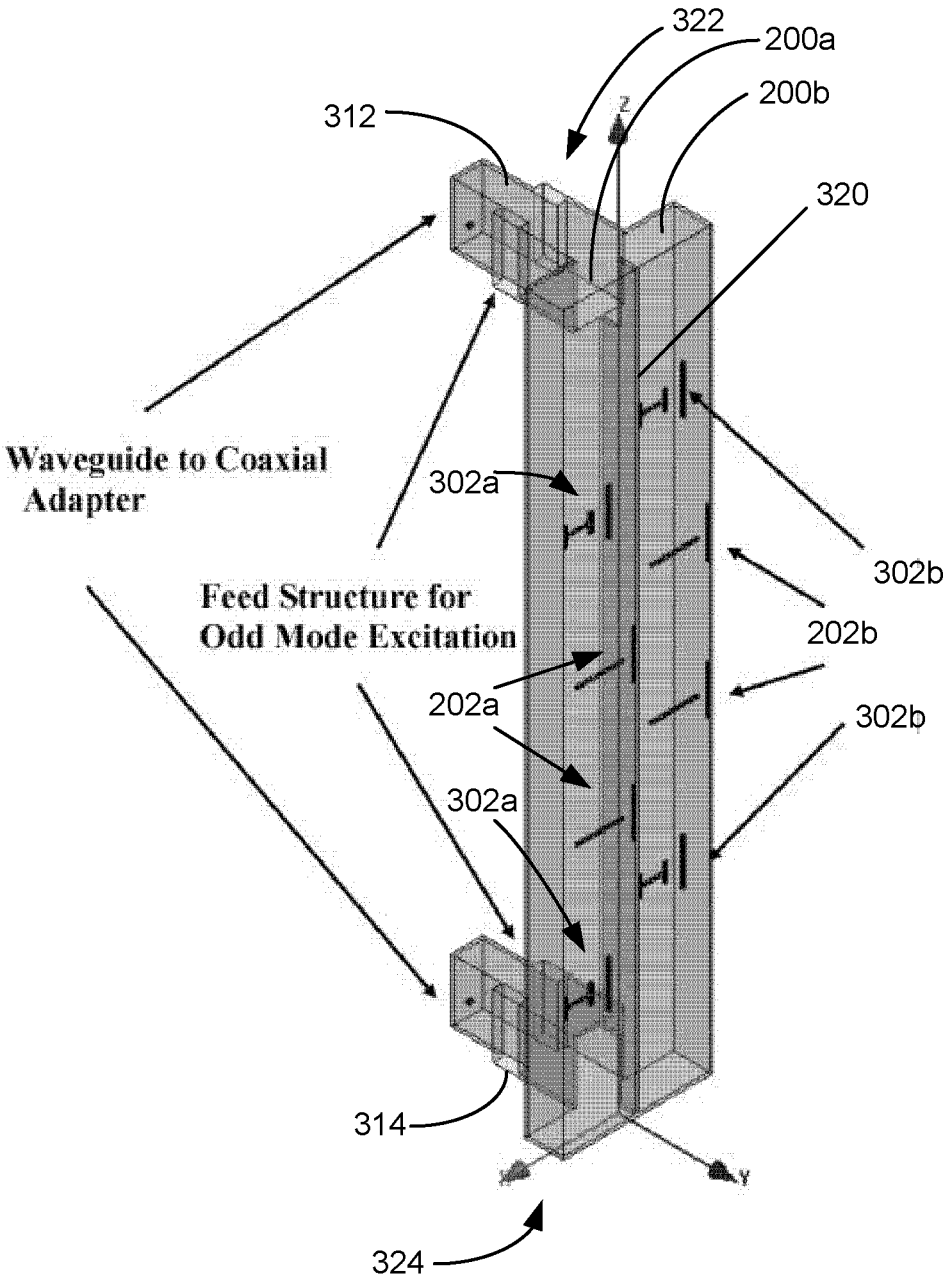
FIG. 3 illustrates a circularly-polarized waveguide slot array in accordance with the present invention.

FIG. 3 illustrates a circular polarized waveguide slot array 300 ("array" for brevity) using the arrangement as shown in FIG. 2. The array 300 includes, in addition to the main slot pairs 202*a* and 202*b*, one or two feed networks 312 and 314 which are coupled at opposite longitudinal ends of the array 300. Exemplary each feed network 312 and 314 includes a waveguide to coaxial adapter coupled to a feed structure for odd mode excitation of both the first and second waveguide slot antennae 200*a* and 200*b*. In particular, each feed network 312 and 314 is operable to provide substantially equal amplitude and complementary-phased signals to the first and second waveguide slot antennae 200*a* and 200*b*. A right hand circular polarized signal can be transmitted or received via the feed network 312 disposed on the longitudinal end 322, and a left hand circular polarized signal can be transmitted or received via the feed network 314 disposed on the longitudinal end 324. Optionally, the array 300 includes control slot pairs 302 which have dimensions different from that of the main slot pairs 202 in order to provide amplitude control of the array 300. Further exemplary, the I-shape of the control slot pairs 302 is operable to produce a resonance for the longitudinal slot of the control slot pair 302, due to that slot's smaller longitudinal length.

As shown in FIG. 3, the array 300 includes a separating wall 320 disposed between the waveguide slot antennae 200*a* and 200*b*, except for a small portion which is removed to accommodate the feed networks 312 and 314, the gap in the separating wall 320 permitting each feed network 312 and 314 to supply substantially equal amplitude, but complementary-phased signals to respective waveguide slot antennae 200*a* and 200*b*. Exemplary, the waveguide slot antennae 200*a* and 200*b* are integrally-formed side-by-side along a common longitudinal axis, for example, sharing a single separating wall 320. The material of the waveguide slot antennae 200*a* and 200*b* may be any of those used for waveguide structures, for example, aluminum, copper, kovar, or any other material which exhibit acceptable (e.g., between 0 to 3 dB) insertion loss at the desired operating frequency/wavelength.

Exemplary, each of the substantially equal amplitude and complementary-phased signals includes a Hx magnetic field component and a Hz magnetic field component, as described in FIG. 1 above. Further exemplary, amplitude match between said signals is within ±1 dB amplitude match, and even more particularly, within ±0.5 dB amplitude match. Further exemplary, the signals are complementary-phased (i.e., at 180 degrees relative phasing) within ±10 degrees, and even more particularly less than ±3 degrees. Further exemplary, the antenna elements 202*a* and 202*b* are positioned such that they are within $\pm\lambda_g/10$ of the desired $\lambda_g/2$ spacing, and even more particularly, within $\pm\lambda_g/20$ of the desired $\lambda_g/2$ spacing.

The waveguide and slot dimensions for an array 300 operating at 2.4-2.5 GHz are shown in FIG. 4. The return loss is shown in FIG. 5, and the elevation and azimuth radiation patterns are shown in FIGS. 6(*a*) and (*b*) respectively.

Figure 7:
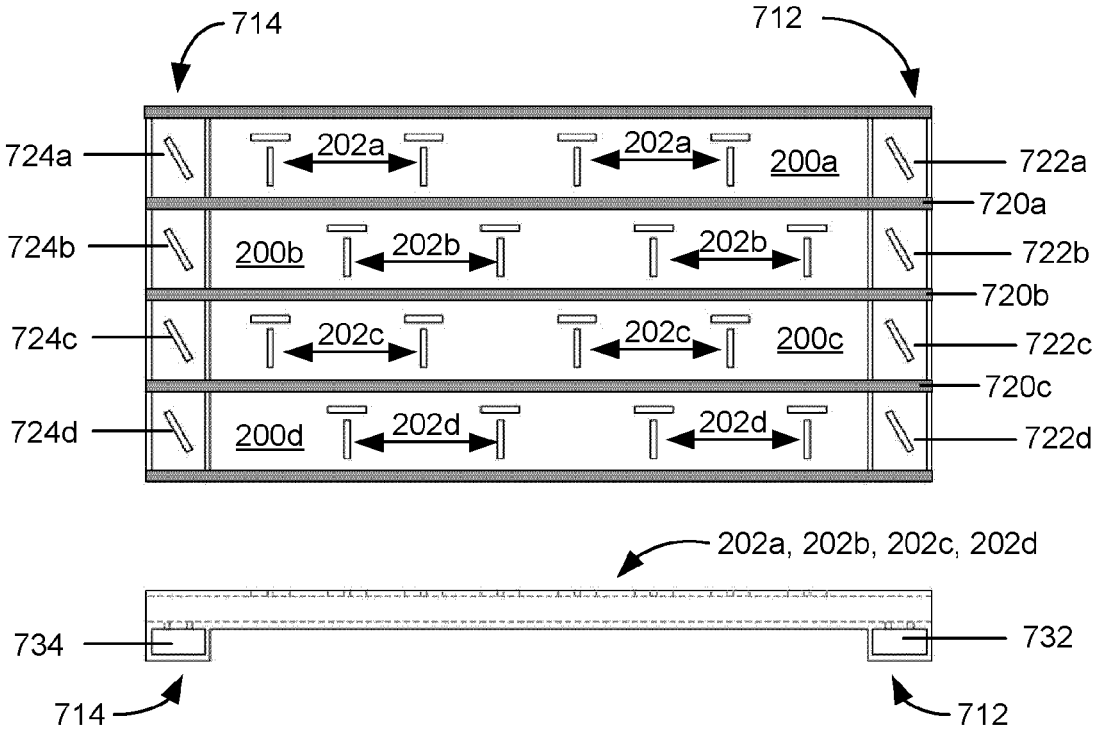
FIG. 7 illustrates a second exemplary embodiment of a circular-polarized waveguide slot array in accordance with the present invention.

FIG. 7 illustrates two plane views of a second exemplary embodiment of a circular polarized waveguide slot array 700 in accordance with the present invention. Four waveguide sections 200*a*-200*d* are shown although any even number of waveguide sections can be implemented in accordance with the present invention. Each waveguide section has corresponding antenna elements/slot pairs 202 disposed thereon, shown as four slot pairs, although any number can be implemented in accordance with the present invention. Respective waveguide sections 200 are separated by a common waveguide wall 720, as shown.

In this embodiment, slot pairs 202*a* and 202*b* on the adjacent waveguide sections 200*a* and 200*b* are spaced apart λg/2 as shown the exemplary embodiments of FIGS. 2A and 2B. Similarly, slot pairs 202*c* and 202*d* are spaced apart λg/2, thus waveguide sections 200*c* and 200*d* are essentially identical to waveguide sections 200*a* and 200*b*, respectively. Array 700 represents an embodiment in which multiple instances of identical waveguide sections are implemented in order to obtain a more uniform antenna pattern.

The slot pairs 202 extend between respective first and second longitudinal ends 712 and 714 of a waveguide section 200. Each waveguide section 200 further includes a first feed slot 722 disposed on the first longitudinal end 712 and a second feed slot 724 disposed at the second longitudinal end 714. The first and second feed slots 722 and 724 operate as an alternative feeding structure to that of feed networks 312 and 314 shown and described in FIG. 3. Feed waveguides 732 and 734 are located on respective longitudinal ends 712 and 714 to supply respective right and left hand circularly polarized signals to feed slots 722 and 724. Exemplary, feed waveguide 732 is arranged along the first longitudinal end 712 and extends traverse thereto, and is coupled to each of the feed slots 722*a*-722*d*. Further particularly, one longitudinal end of the feed waveguide 732 is terminated (e.g., in a short), and the opposite longitudinal end is operable to transmit/receive a first signal (e.g., a RHCP signal) from each of the feed slots 722*a*-722*d*. Similarly, feed waveguide 734 is arranged along the second longitudinal end 714 and extends traverse thereto, and is coupled to each of the feed slots 724*a*-724*d*. Further particularly, one longitudinal end of the feed waveguide 734 is terminated (e.g., in a short), and the opposite longitudinal end is operable to transmit/receive a second signal (e.g., a LHCP signal) from each of the feed slots 724*a*-724*d*.

Figure 8:
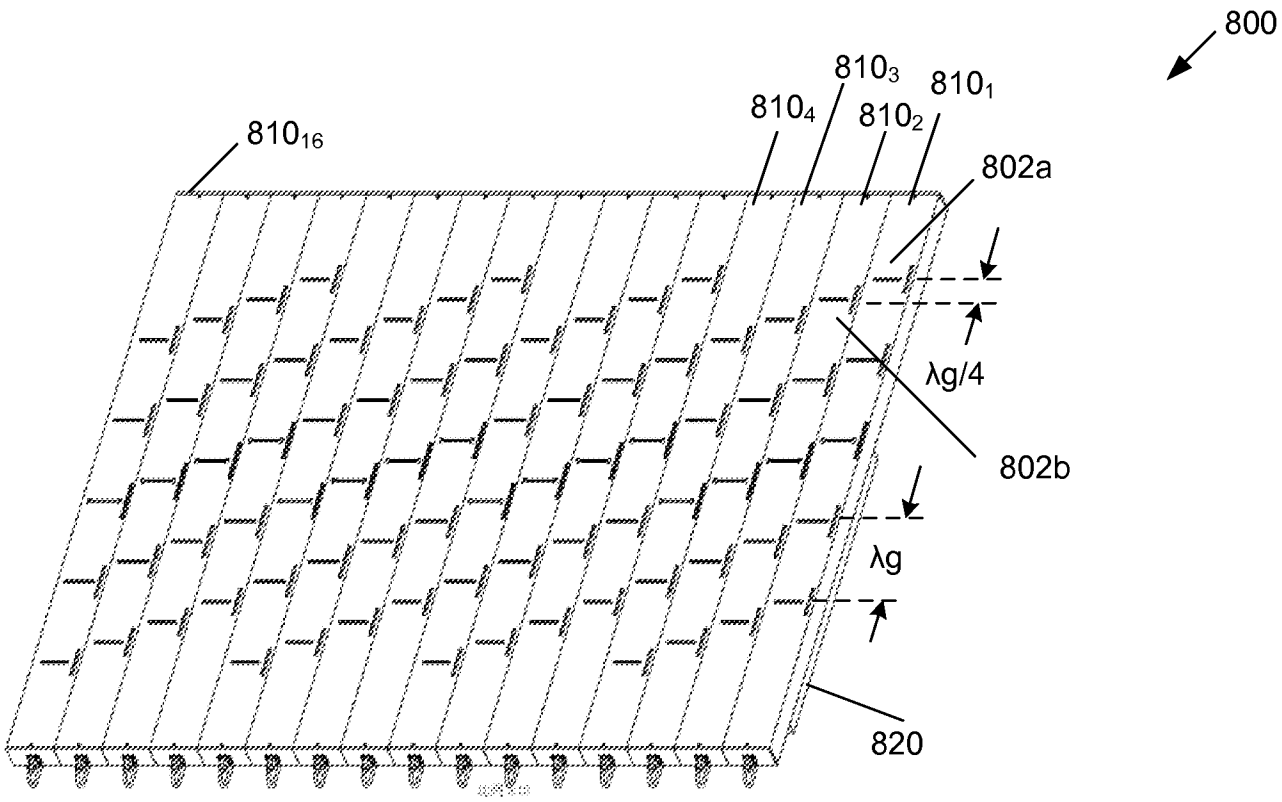
FIG. 8 illustrates a third exemplary embodiment of a circularly-polarized waveguide slot array in accordance with the present invention.
Figure 9:
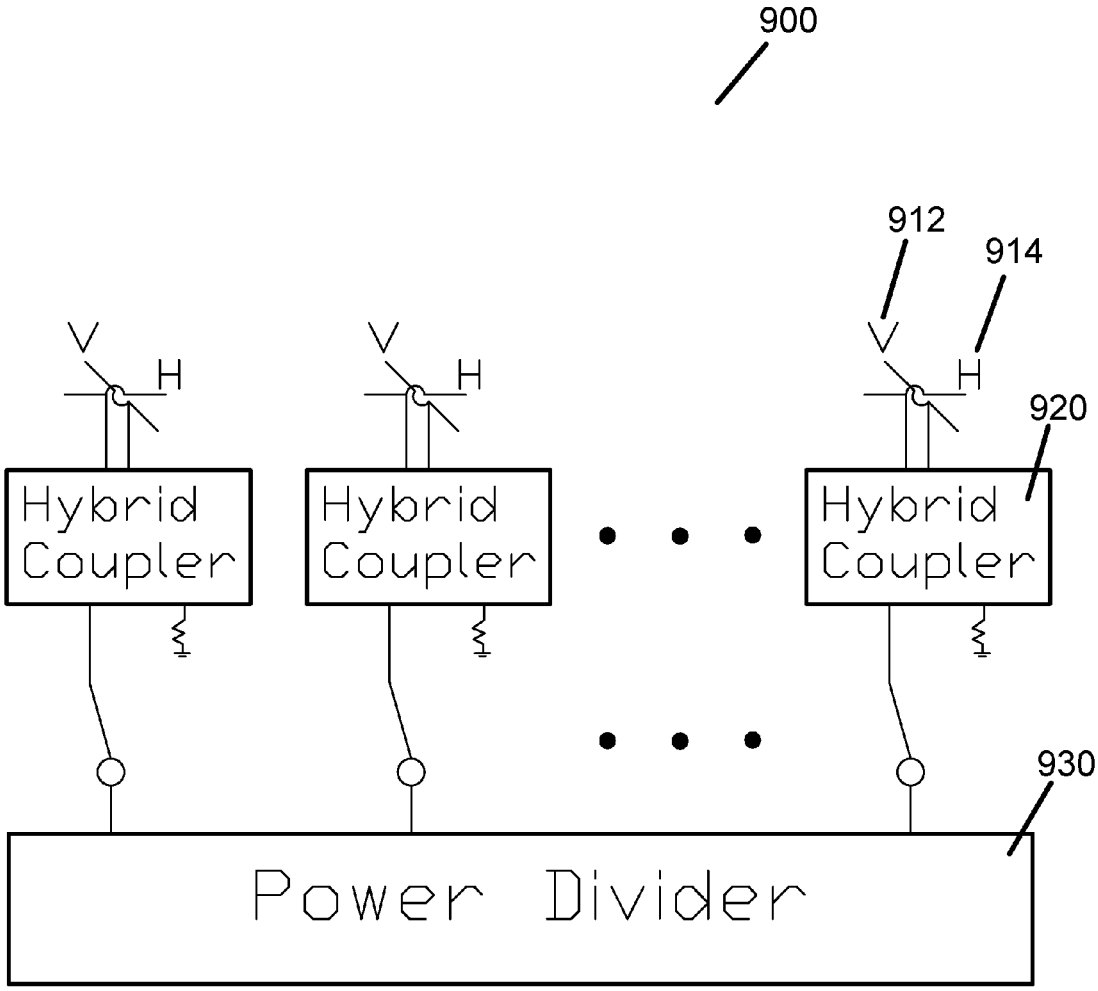
FIG. 9 illustrates a first conventionally known circularly-polarized antenna array.
Figure 10:
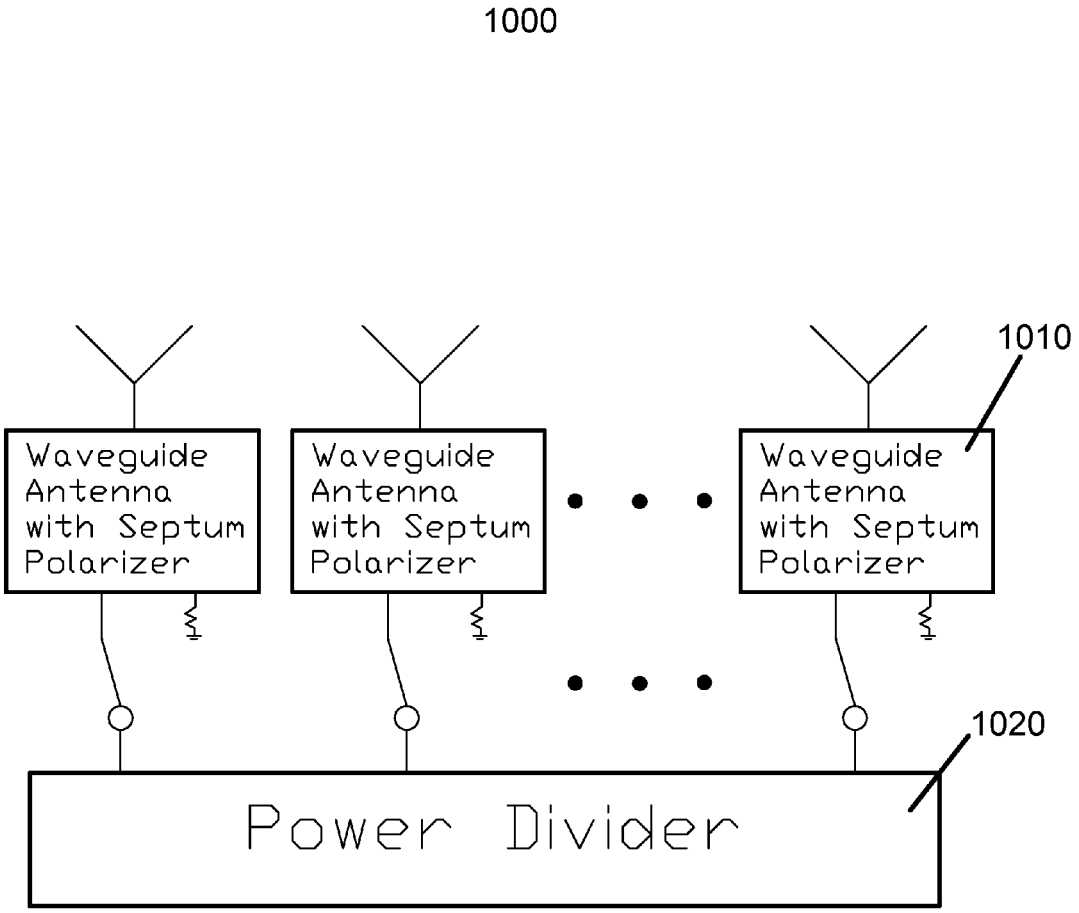
FIG. 10 illustrates a second conventionally known circularly-polarized antenna array.

FIG. 8 illustrates a third exemplary embodiment of a circularly polarized waveguide slot array 800 in accordance with the present invention. Sixteen waveguide sections $\mathbf{810}_1$-$\mathbf{810}_{16}$ are shown. Each waveguide section has corresponding antenna elements/slot pairs disposed thereon (five slot pairs per waveguide section shown), although any number can be implemented in accordance with the present invention. Exemplary, each waveguide section 810 includes a load (exemplary, 50 ohms not shown) located at the end of the waveguide section opposite the end coupled to the power divider 820. The array 800 further includes a power divider 820 operable to feed each of the waveguide sections 810.

As shown, the slot pairs on adjacent waveguide sections are offset by substantially $\lambda_g/4$ as measured along said longitudinal axis. In this arrangement, four waveguide sections ($\mathbf{810}_1$-$\mathbf{810}_4$) make up an array per guide wavelength $\lambda_g$, as four slot pair spacings add up to one complete guide wavelength $\lambda_g$. Slot waveguide sections $\mathbf{810}_1$ and $\mathbf{810}_3$ represent complementary-phased waveguide sections, as does slot waveguide sections $\mathbf{810}_2$ and $\mathbf{810}_4$. This arrangement of four waveguide sections, each providing a slot pair spacing of $\lambda_g/4$, is repeated four times to provide for a more uniform antenna pattern for the array. The skilled person will appreciate that offsets of different dimensions may be used, e.g., λg/16, λg/8, or λg/2), the slot pair spacing preferably being less than or equal to a $\lambda_g/2$. Slot pairs disposed on the same waveguide section are offset substantially $\lambda_g$ away along the longitudinal axis, as shown and described above.

In accordance with the foregoing, the present invention includes the following inventive embodiments:

A circular polarized waveguide slot array, examples of which shown in FIGS. 2A, 2B, 3 and 8, includes first and second waveguide slot sections 200*a* and 200*b*. The first waveguide slot section 200*a* extends along a longitudinal axis, and includes an antenna element 202*a* configured to transmit or receive a circularly polarized signal. The second waveguide slot section 200*b* is coupled side-to-side to the first waveguide slot section 200*a* and extends along said longitudinal axis. The second waveguide slot section 202*b* includes an antenna element 202*b* configured to transmit or receive said circularly polarized signal at a phase which is substantially complementary to said circularly polarized signal transmitted by or received by the antenna element 202*a* of the first waveguide slot section 200*a*. The antenna element 202*a* disposed on the first waveguide slot antenna 200*a* is offset from said antenna element 202*b* disposed on the second waveguide slot antenna 200*b* substantially equal to one half of a predefined guide wavelength $\lambda_g$ along said longitudinal axis.

In a particular embodiment, the antenna element 202*a* included on the first waveguide 200*a* comprises a slot pair comprising a longitudinal slot extending along said longitudinal axis and a traverse slot extending substantially orthogonal to the longitudinal slot. Similarly, the antenna element 202*b* included on the second waveguide 200*b* comprises a slot pair comprising a longitudinal slot extending along said longitudinal axis and a traverse slot extending substantially orthogonal to the longitudinal slot. Further exemplary, the traverse slot disposed on the first waveguide is offset from the traverse slot disposed on the second waveguide substantially one half of said predefine guide wavelength $\lambda_g$ along the longitudinal axis.

In another embodiment, the first and second waveguide slot antennae 202*a* and 202*b* include a first longitudinal end 322 and a second longitudinal end 324. Further exemplary, a first feed network 312 is coupled to the first longitudinal end 322 of the first and second waveguide slot antennae, and is operable to transmit to, or receive from the first and second waveguide slot antennae substantially equal amplitude, and complementary-phased signals. Similarly, a second feed network 314 is coupled to the second longitudinal end 324 of the first and second waveguide slot antenna, and is operable to transmit to, or receive from the first and second waveguide slot antennae substantially equal amplitude, and complementary-phased signals.

In another embodiment, the first waveguide slot antenna 200*a* includes a plurality of antenna elements 202*a* distributed along said longitudinal axis, said plurality of antenna elements separated by substantially one predefined guide wavelength $\lambda_g$ along said longitudinal axis. Similarly, the second waveguide slot antenna 200*b* includes a plurality of antenna elements 202*b* distributed along said longitudinal axis, said plurality of antenna elements separated by substantially one predefined guide wavelength $\lambda_g$ along said longitudinal axis.

In a further embodiment, an example of which is shown in FIG. 8, the circularly polarized waveguide slot array further includes a third and fourth waveguide sections. As it relates to FIG. 8, the previously-described first and second waveguide sections are waveguide sections $\mathbf{810}_1$ and $\mathbf{810}_3$ as they include the afore-described antenna elements which are spaced $\lambda_g/2$ apart, these waveguides being coupled to each other via intervening waveguide section $\mathbf{810}_2$. The third and four waveguide sections are represented by waveguide sections $\mathbf{810}_2$ and $\mathbf{810}_4$. The third waveguide section $\mathbf{810}_2$ is coupled (directly) side-to-side and between the first and second waveguide slot sections 810$_1$ and 810$_3$, and extends along said longitudinal axis. The third waveguide slot section 810$_2$ includes an antenna element for transmitting or receiving the circularly polarized signal at a third phase which is offset from the circularly polarized signal transmitted by or received by the first and second waveguide slot sections. The fourth waveguide section 810$_4$ is coupled (via second waveguide section 810$_3$) side-to-side with the second waveguide slot section 810$_3$ and extends along the longitudinal axis. The fourth waveguide slot section includes an antenna element for transmitting or receiving the circularly polarized signal at a fourth phase which is substantially complementary to the circularly polarized signal transmitted by or received by the third waveguide slot section. The antenna element disposed on the third waveguide slot section is offset from said antenna element disposed on the fourth waveguide slot section substantially one half of a predefined guide wavelength $\lambda_g$ along said longitudinal axis.

In another embodiment, the circularly polarized waveguide slot array includes a plurality of waveguide slot sections which extend along a longitudinal axis and which are coupled side-to-side, each waveguide section including a plurality of antenna elements operable for transmitting or receiving a circularly polarized signal. Further particularly, one of the plurality of antenna elements disposed on a first waveguide section is offset along the longitudinal axis relative to one of the plurality of antenna elements disposed on the second waveguide section. Further exemplary, each of the plurality of antenna elements comprises a longitudinal slot extending along said longitudinal axis and a traverse slot extending substantially orthogonal to the longitudinal slot. Further exemplary of this embodiment, each waveguide section is characterized as having a predefined guide wavelength $\lambda_g$, the aforementioned plurality of waveguide slot sections comprises an even number N, and the one of the plurality of antenna elements disposed on the first waveguide section is offset along the longitudinal axis $\lambda_g/N$ relative to one of the plurality of antenna elements disposed on the second waveguide.

As readily appreciated by those skilled in the art, the described processes and operations may be implemented in hardware, software, firmware or a combination of these implementations as appropriate. In addition, some or all of the described processes and operations may be implemented as computer readable instruction code resident on a computer readable medium, the instruction code operable to control a computer of other such programmable device to carry out the intended functions. The computer readable medium on which the instruction code resides may take various forms, for example, a removable disk, volatile or non-volatile memory, etc.

The terms "a" or "an" are used to refer to one, or more than one feature described thereby. Furthermore, the term "coupled" or "connected" refers to features which are in communication with each other (electrically, mechanically, thermally, as the case may be), either directly, or via one or more intervening structures or substances. The sequence of operations and actions referred to in method flowcharts are exemplary, and the operations and actions may be conducted in a different sequence, as well as two or more of the operations and actions conducted concurrently. Reference indicia (if any) included in the claims serves to refer to one exemplary embodiment of a claimed feature, and the claimed feature is not limited to the particular embodiment referred to by the reference indicia. The scope of the claimed feature shall be that defined by the claim wording as if the reference indicia were absent therefrom. All publications, patents, and other documents referred to herein are incorporated by reference in their entirety. To the extent of any inconsistent usage between any such incorporated document and this document, usage in this document shall control.

The foregoing exemplary embodiments of the invention have been described in sufficient detail to enable one skilled in the art to practice the invention, and it is to be understood that the embodiments may be combined. The described embodiments were chosen in order to best explain the principles of the invention and its practical application to thereby enable others skilled in the art to best utilize the invention in various embodiments and with various modifications as are suited to the particular use contemplated. It is intended that the scope of the invention be defined solely by the claims appended hereto.

What is claimed is:

1. A circular polarized waveguide slot array, comprising:

a first waveguide slot section extending along a longitudinal axis, the first waveguide slot section including a plurality of antenna elements for transmitting or receiving a circularly polarized signal; and a second waveguide slot section coupled side-to-side with the first waveguide slot section and extending along said longitudinal axis, the second waveguide slot section including a plurality of antenna elements for transmitting or receiving said circularly polarized signal at a phase which is substantially complementary to said circularly polarized signal transmitted by or received by the first waveguide slot section, wherein one of said plurality of antenna elements disposed on the first waveguide slot section is offset from a corresponding one of said plurality of antenna elements disposed on the second waveguide slot section substantially one half of a predefined guide wavelength $\lambda_g$ along said longitudinal axis, wherein each of said plurality of antenna elements included on the first waveguide slot section comprises a slot pair comprising a longitudinal slot extending along said longitudinal axis and a traverse slot extending substantially orthogonal to the longitudinal slot, wherein each of said plurality of antenna elements included on the second waveguide slot section comprises a slot pair comprising a longitudinal slot extending along said longitudinal axis and a traverse slot extending substantially orthogonal to the longitudinal slot, wherein the traverse slot disposed on the first waveguide slot section is offset from the traverse slot disposed on the second waveguide slot section substantially one half of said predefine guide wavelength $\lambda_g$ along the longitudinal axis, wherein the first waveguide slot section further includes a control slot pair having said longitudinal slot and said traverse slot, whereby the traverse slot extends to two opposing and longitudinally-oriented slot sections, and wherein the second waveguide slot section further includes a control slot pair having said longitudinal slot and said traverse slot, whereby the traverse slot extends to two opposing and longitudinally-oriented slot sections.

2. The circular polarized waveguide slot array of claim 1, further comprising:

a first feed network coupled to a first longitudinal end of the first and second waveguide slot sections and operable to transmit to or receive from the first and second waveguide slot sections substantially equal amplitude and complementary-phased signals;

a second feed network coupled to a second longitudinal end of the first and second waveguide slot sections and operable to transmit to or receive from the first and second waveguide slot sections substantially equal amplitude and complementary-phased signals.

3. The circular polarized waveguide slot array of claim 1, wherein the first waveguide slot section includes a plurality of antenna elements distributed along said longitudinal axis, said plurality of antenna elements separated by substantially one predefined guide wavelength $\lambda_g$ along said longitudinal axis.

4. The circular polarized waveguide slot array of claim 1, wherein the second waveguide slot section includes a plurality of antenna elements distributed along said longitudinal axis, said plurality of antenna elements separated by substantially one predefined guide wavelength $\lambda_g$ along said longitudinal axis.

5. The circularly polarized waveguide slot array of claim 1, further comprising:

a third waveguide slot section coupled side-to-side and between the first and second waveguide slot sections, and extending along said longitudinal axis, the third waveguide slot section including an antenna element for transmitting or receiving said circularly polarized signal at a third phase which is offset from said circularly polarized signal transmitted by or received by the first and second waveguide slot sections; and a fourth waveguide slot section coupled side-to-side with the second waveguide slot section and extending along said longitudinal axis, the fourth waveguide slot section including an antenna element for transmitting or receiving said circularly polarized signal at a fourth phase which is substantially complementary to said circularly polarized signal transmitted by or received by the third waveguide slot section; and wherein said antenna element disposed on the third waveguide slot section is offset from said antenna element disposed on the fourth waveguide slot section substantially one half of a predefined guide wavelength $\lambda_g$ along said longitudinal axis.

6. The circularly polarized waveguide slot array of claim 5, wherein said antenna element included on the third waveguide slot section comprises a slot pair comprising a longitudinal slot extending along said longitudinal axis and a traverse slot extending substantially orthogonal to the longitudinal slot, wherein said antenna element included on the fourth waveguide slot section comprises a slot pair comprising a longitudinal slot extending along said longitudinal axis and a traverse slot extending substantially orthogonal to the longitudinal slot, and wherein the traverse slot disposed on the third waveguide slot section is offset from the traverse slot disposed on the fourth waveguide slot section substantially one half of said predefine guide wavelength $\lambda_g$ along the longitudinal axis.

7. The circularly polarized waveguide slot array of claim 5, wherein the third waveguide slot section includes a plurality of antenna elements distributed along said longitudinal axis, said plurality of antenna elements separated by substantially one predefined guide wavelength $\lambda_g$ along said longitudinal axis.

8. The circularly polarized waveguide slot array of claim 5, wherein the fourth waveguide slot section includes a plurality of antenna elements distributed along said longitudinal axis, said plurality of antenna elements separated by substantially one predefined guide wavelength $\lambda_g$ along said longitudinal axis.

9. A circularly polarized waveguide slot array, comprising:

a plurality of waveguide slot sections extending along a longitudinal axis and coupled side-to-side, and each of the plurality of waveguide slot sections comprising a plurality of antenna elements operable for transmitting or receiving a circularly polarized signal, wherein one of the plurality of antenna elements disposed on a first waveguide slot section is offset along the longitudinal axis relative to one of the plurality of antenna elements disposed on a second waveguide slot section;

wherein each of the plurality of antenna elements comprises a longitudinal slot extending along said longitudinal axis and a traverse slot extending substantially orthogonal to the longitudinal slot, wherein the first waveguide slot section further includes a control slot pair having said longitudinal slot and said traverse slot, whereby the traverse slot extends to two opposing and longitudinally-oriented slot sections, wherein the second waveguide slot section further includes a control slot pair having said longitudinal slot and said traverse slot, whereby the traverse slot extends to two opposing and longitudinally-oriented slot sections.

10. The circularly polarized waveguide slot array of claim 9, wherein each waveguide slot section is characterized as having a predefined guide wavelength $\lambda_g$, wherein the plurality of waveguide slot sections comprises an even number N, and wherein said one of the plurality of antenna elements disposed on the first waveguide slot section is offset along the longitudinal axis $\lambda_g/N$ relative to one of the plurality of antenna elements disposed on the second waveguide.

11. The circularly polarized waveguide slot array of claim 10, wherein the number of waveguide slot sections is two, and wherein the offset along the longitudinal axis is $\lambda_g/2$.

12. The circularly polarized waveguide slot array of claim 10, wherein the number of waveguide slot sections is four, and wherein the offset along the longitudinal axis is $\lambda_g/4$.

* * * * *